United States Patent [19]

Katsume

[11] 4,303,192

[45] Dec. 1, 1981

[54] FULL JACKET-WORM CENTRIFUGE

[76] Inventor: Hide Katsume, Inage Higashi 3-3-16, Chiba-shi, Chiba-ken, Japan

[21] Appl. No.: 160,215

[22] Filed: Jun. 17, 1980

[30] Foreign Application Priority Data

Jul. 5, 1979 [JP] Japan ..... 54-84439

[51] Int. Cl.[3] ..... B04B 1/20

[52] U.S. Cl. ..... 233/7; 233/24

[58] Field of Search ..... 233/6, 7, 24; 210/360 R, 369, 739, 145

[56] References Cited

U.S. PATENT DOCUMENTS

| | | | |
|---|---|---|---|
| 2,999,797 | 9/1961 | Campbell | 210/739 |
| 3,321,131 | 5/1967 | Cak | 233/7 |
| 3,428,248 | 2/1969 | Andreson et al. | 233/7 |
| 3,568,919 | 3/1971 | Nielson | 233/7 |
| 3,575,709 | 4/1971 | Lerney | 233/7 |
| 3,923,241 | 12/1975 | Cyphelly | 233/7 |
| 3,960,318 | 6/1976 | Dahlbey | 233/7 |
| 4,167,243 | 9/1979 | Jackson | 233/7 |
| 4,198,298 | 4/1980 | Zucherman | 210/793 |
| 4,228,949 | 10/1980 | Jackson | 233/7 |

FOREIGN PATENT DOCUMENTS

| | | |
|---|---|---|
| 1532678 | 3/1970 | Fed. Rep. of Germany . |
| 2612696 | 10/1976 | Fed. Rep. of Germany . |

*Primary Examiner*—Theodore A. Granger

*Attorney, Agent, or Firm*—Hill, Van Santen, Steadman, Chiara & Simpson

[57] ABSTRACT

A full jacket-worm centrifuge is disclosed for continuous separation of water-sludge mixtures. The centrifuge has a cylindrical drum jacket with a conically tapered portion in a direction of a solid matter discharge. A worm conveyor having cylindrical and conical portions is arranged within the drum jacket. Between a slurry inlet on the drum jacket and the solid matter discharge a liquid separation product discharge is arranged. Between this liquid discharge and the solid matter discharge a cross-sectional constriction is provided having a plate extending radially to a point spaced from an interior side of the drum jacket. Means are provided to control a differential speed between the drum jacket and worm conveyor or solid matter quantity supplied per unit of time to the centrifuge according to torque of the worm conveyor, solid matter concentration in the solid matter discharge, or solid matter concentration in the liquid separation product discharge.

5 Claims, 2 Drawing Figures

FULL JACKET-WORM CENTRIFUGE

BACKGROUND OF THE INVENTION

The invention relates to a full jacket-worm centrifuge, in particular for continuous separation of water-sludge mixtures. An approximately cylindrical drum jacket which is conically tapered in the direction of the solid matter discharge is provided together with a cylindrical conical worm conveyor arranged axially therein. A slurry feed is also provided as well as a drive for the cylinder jacket and worm conveyor.

In the case of full jacket-worm centrifuges of the cited type, the drum or cylinder jacket and the worm conveyor execute a rotational movement in the same direction but at a different speed. The slurry being fed is introduced through the slurry inlet into an annular chamber bounded between the interior side of the cylinder jacket and the worm conveyor, and is separated therein under the influence of an artificial field of gravity so that a solid matter layer is deposited from the liquid and is formed on the interior surface of the drum jacket. The liquid is conveyed through the exterior through a liquid drain opening, whereas the solid matter layer is transported by the worm conveyor, rotating at a different speed in relation to the drum jacket, to the conically tapered solid matter discharge of the drum jacket, and is finally discharged toward the exterior at the end of the conical drum member.

In the water-extraction (dehydration) of sludges, difficulties occur, in particular when the fineness of the solid materials and/or their density difference relative to the water are very small.

The discharge of the sludge-solid matter components concentrated in the centrifuge over the ascending region of the conical drum jacket presents particular difficulties. Under the influence of high centrifugal forces, a considerable tendency occurs for the solid materials to flow back in the direction of the cylindrical drum section.

Therefore, as can be learned e.g. from the German Offenlegungsschriften Nos. 1,532,678 as well as 2,612,696 both incorporated herein by reference, a radial disk or baffle has been arranged in the region of the transition from the cylindrical to the conical section of the cylinder jacket in order to thereby assist the transport into the conical jacket section.

Since this technique, itself, is not sufficient in most cases to guarantee a reliable discharge of the fine solid matter, it has also already been attempted to assist the transport of solid matter in the conical jacket section of the centrifuge through raising of the liquid level. However, this technique entails the disadvantage that the liquid component, which is discharged with the solid matter is relatively great and hence the water-extraction effect is relatively poor. The known measures and apparatus all have the disadvantage that, given fluctuating operating conditions, either the concentration or thickening effect or the clarification or purification effect is negatively influenced.

SUMMARY OF THE INVENTION

It is an object of the invention to provide an apparatus which effects a maximum degree of concentration or thickening and simultaneously a maximum degree of purification.

This result is to be achieved in a constant and reproducible fashion even under varying operating conditions.

The solution of the problem is achieved with the combination of the following features:

(a) at least one liquid-drain opening is provided, viewed in an axial direction, between the slurry inlet and the solid matter discharge;

(b) between a liquid-drain opening and the solid matter-discharge a cross-sectional constriction is provided, for example, a radially arranged disk which terminates at the exterior at a spacing from the interior side of the cylinder jacket;

(c) an installation is provided for controlling and/or regulating the differential speed between the drum jacket and the worm conveyor and/or the solid matter quantity supplied to the centrifuge per unit of time, according to an operating parameter, for example, the torque of the worm conveyor and/or solid matter concentration in the solid matter discharge and/or in the liquid separation product discharge.

With the invention the advantages result that the centrifuge can be adjusted to defined operating parameters within varying operating conditions and that therefore an optimum result can be achieved such that a maximum of concentration or thickening as well as of purification or clarification is obtained.

In addition, through the inventive features, the prerequisite for computer-controlled process automation is created.

In an embodiment of the invention, axially running channels are provided on the worm member serving as liquid-drain conduit members.

In a further embodiment of the full jacket-worm centrifuge, it is provided with the invention that the drive of the worm exhibits an installation for ascertaining the torque which converts the ascertained values into torque-proportional signals, and which presents these signals to the installation for controlling and/or regulating for the purpose of adjustment of the speed of the drum jacket and worm conveyor and/or for the purpose of adjustment of the slurry quantity supplied per unit of time.

Installations of the cited type for ascertaining a torque are well known to the expert and can be realized either with electric, hydraulic, or mechanical commercial techniques.

With this technique, the advantage results since a fully automatic adjustment of optimum operating conditions within defined limits is rendered possible. There thus results the possibility of a process-automation with the aid of known and conventional electronic process computers. As a result of this particular embodiment, a surprisingly good operating result with economically favorable operating conditions is achieved.

A further embodiment of the invention provides that flow meters are outlet-connected to the solid matter discharge and/or liquid separation product discharge. These flow meters determine the quantity and/or the solid matter concentration in one of the discharges and convert the determined values into electric signals and presents these signals to the installation for controlling and/or regulating.

DESCRIPTION OF THE PREFERRED EMBODIMENTS

Figure 1:
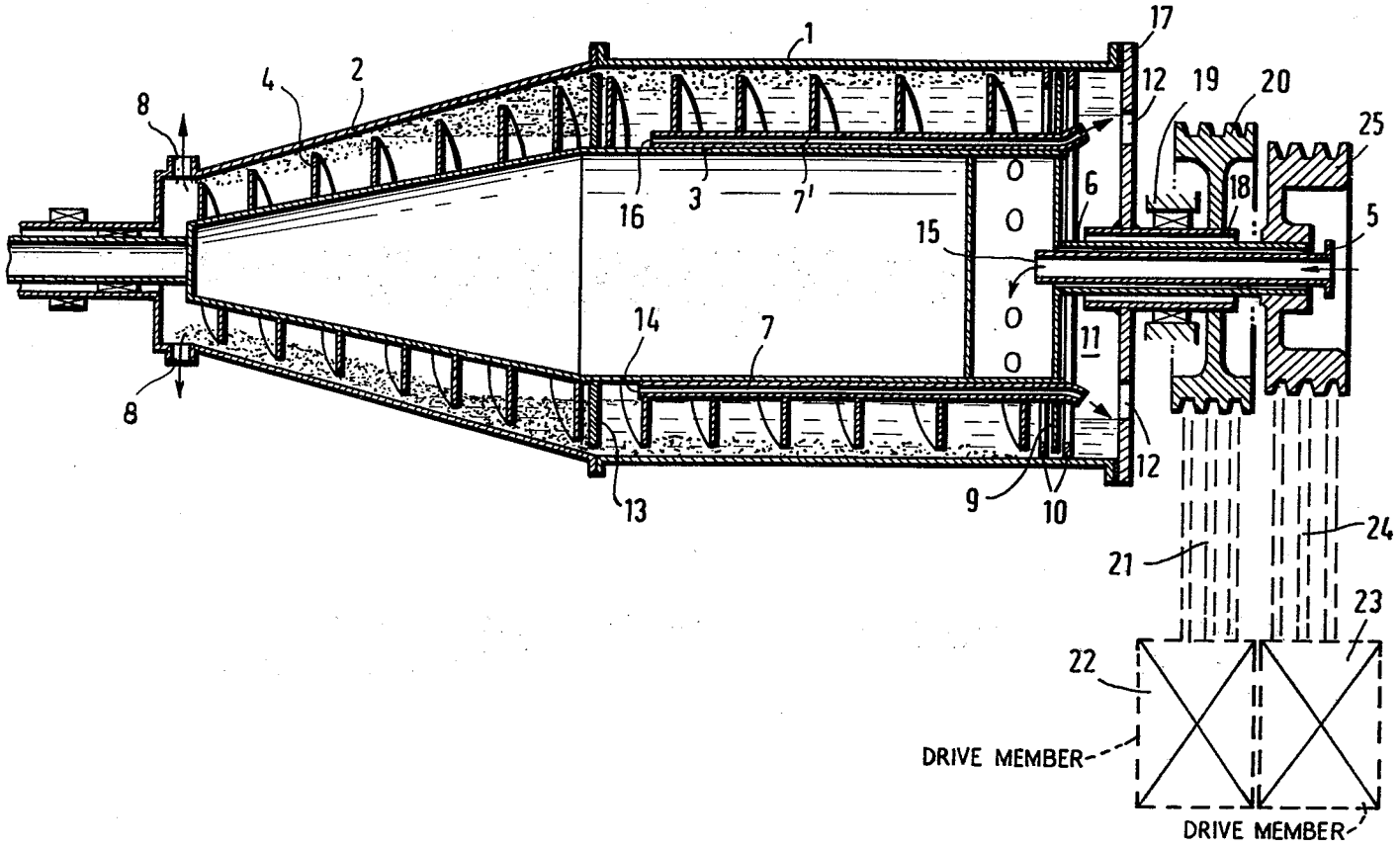
FIG. 1 illustrates in a cross-sectional view a full jacket-worm centrifuge according to the invention.

As FIG. 1 shows, the full jacket-worm centrifuge consists of a cylindrical jacket portion 1 and a following conical jacket portion 2. In this centrifuge jacket formed thereby a worm conveyor is arranged in a rotationally mobile fashion coaxially and with minimum spacing in relation to the cylinder jacket. This worm conveyor consists of a hollow-designed worm member 3 and a worm spiral arranged in exterior fashion on the worm member. On the right side of the full jacket-worm centrifuge illustrated in the drawing, there is provided for the supply of solid matter-liquid mixture to be separated, a supply line 51 and a pipe 5 which is positioned coaxially through the hollow shaft 6 engaging on the worm member 3. For the discharge of liquid from the purification or clarification region, liquid-drain openings 14, 16, designed as axial channels 7, 7', are provided at the exterior on the worm member, whereas openings 8 are provided in the end region of the conical jacket for the discharge of the solid matter. A front seal of the worm member 3 at the drive-side end is formed by a stop plate 9 between two rings 10 forming a labyrinth seal. The deposited, purified or clear liquid separation product is drained off to the exterior through openings 12.

On the worm member 3, in the transition region from the cylindrical portion 1 to the conical portion 2, a radial disk 13 is arranged which terminates externally with a spacing from the interior side of the cylinder jacket 1, 2. The liquid-drainage openings 14, 16, which are provided in the case of the uniflow centrifuge between the slurry inlet 15 and the solid matter discharge 8, are located between the disk 13 and the slurry inlet 15. The cylindrical jacket section 1 is equipped on the front face with a stop plate 17 and is fixedly connected with the axle tube 18 which, in turn, is rotatably mounted in the bearing arrangement 19. The axle tube 18 is equipped with a drive pulley 20, which, via a V-belt transmission 21, is driven in a manner which is known per se, by the drive member 22 which is schematically illustrated. 23 designates an additional drive member which, via the schematically illustrated V-belt transmission 24, drives the V-belt pulley 25, in fixed connection with the worm member 3, likewise rotatably mounted, and hence drives the worm member 3.

Figure 2:
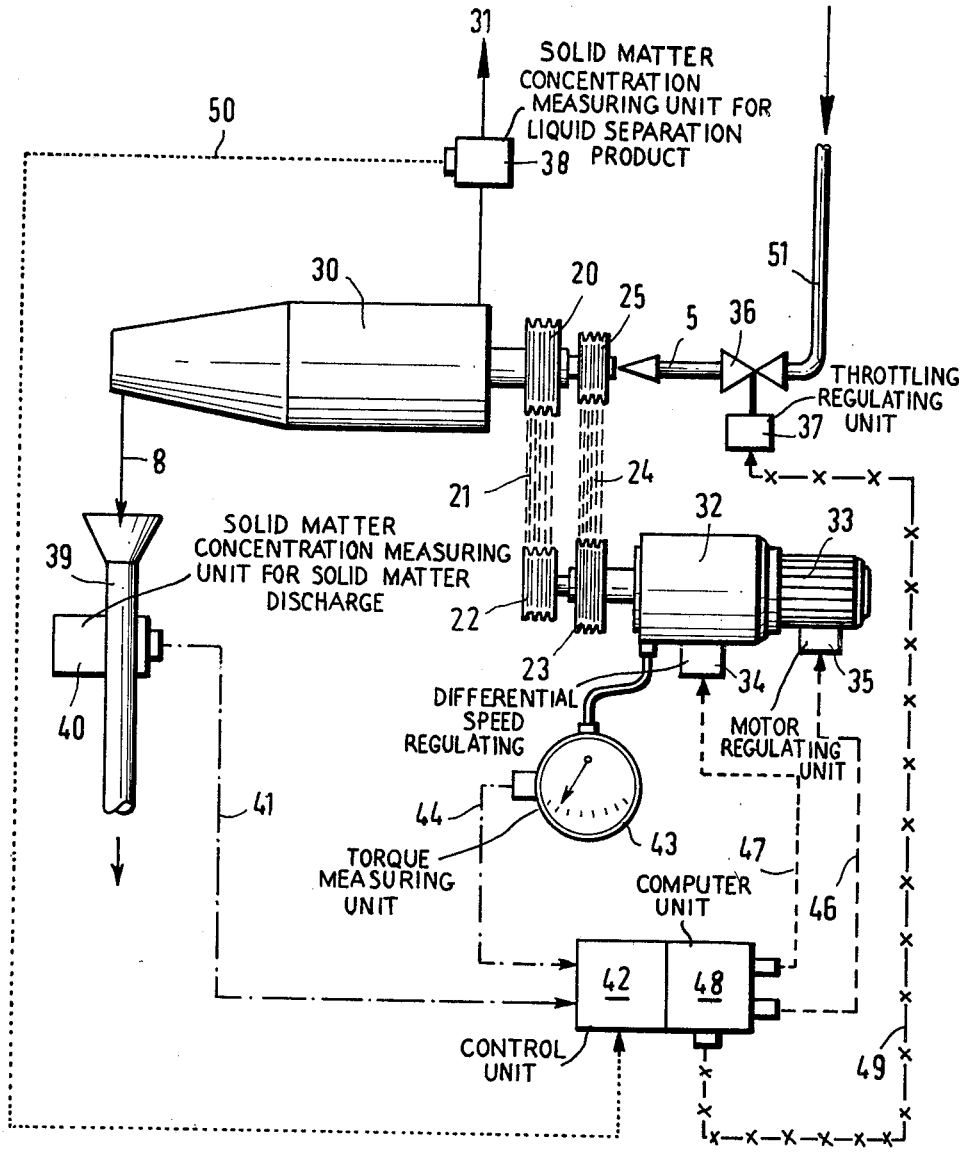
FIG. 2 illustrates in a block circuit diagram the full jacket-worm centrifuge according to FIG. 1 with an installation for controlling and/or regulating the speed of the drum jacket and worm conveyor and/or the quantity of slurry delivered to the centrifuge per unit of time.

FIG. 2 illustrates the full jacket-worm centrifuge 30 with the solid matter discharge 8 as well as with the drain 31 for purified clear liquid separation product. According to the previous description in FIG. 1, the drive of the full jacket-worm centrifuge comprises the V-belt pulleys 20 and 25 with the respective V-belt transmissions 21 and 24, as well as the two drive members 22 and 23. The latter are connected to a differential gear 32 which is driven by the motor 33. The differential gear 32 is capable of adjusting the differential speed of the centrifuge jacket 1, 2, and the worm member 3. The adjustment proceeds in a fashion known to the expert, for example, by means of electric, hydraulic or mechanical means, and is therefore not illustrated in detail functionally and structurally, but merely schematically indicated by the adjustment installation 34.

The speed of the motor 33 is generally constant; however, it can also be continuously adjustable or adjustable in stages. The regulating installation is likewise only schematically illustrated with the corresponding control or regulating member 35.

In addition, the entry pipe 5 for the sludge-water mixture to be separated is equipped with an installation, for example, a throttling member 36 with associated control unit 37, which permits an adjustment of the incoming solid matter and/or slurry quantity. At the drain 8 for the solid matter, a pipe 39 is arranged and equipped with a measuring apparatus or unit 40, which determines the quantity and/or the solid matter concentration in the concentrated sludge being drained and converts the resulting value into an electrical signal. This electrical signal is fed to a control and computation unit 42, 48 with the control line 41. In addition, the differential gear 32 is equipped with a torque measuring unit 43 for determining the torque of the worm member 3. This unit 43 converts the determined torque value into torque-proportional electrical signals and likewise feeds the latter to the computation unit 42, 48 with the aid of the control line 44. This unit 42, 48 calculates in well known manner on the basis of specified dependencies, the control values for the speed of the jacket member 1 and the differential speed between jacket member 1 and worm member 3 of the full jacket-worm centrifuge, and conveys these values, through the control line 47 to the regulating or adjustment unit 34 of the differential gear 32.

In case the adjustment value receives a limit, further adjustment possibilities, for example, through change of the slurry quantity supplied per unit of time, or through change of the speed of the motor 33 are, in addition, provided.

The function of the apparatus illustrated in FIGS. 1 and 2 is as follows. After switching on motor 33, the full jacket-worm centrifuge 30 is set into rotational movement. The drive, which comprises a differential gear 32 with the two V-belt pulleys 22, 23 and the V-belt transmissions 21, 24, as well as the drive pulleys 20, 25, which drives the drum 1, 2 as well as the worm member 3 at a given speed is designed so that first a preselected speed and a preselected differential speed between the two rotating members of the centrifuge is achieved. Subsequently, the throttling member 36 is opened, and the slurry containing a mixture of liquid and solid materials, runs into the centrifuge 30 through the inlet 51, 5, 15. Solid matter is centrifuged toward the exterior, whereby a layer of solid matter is accumulated on the interior jacket 1, 2 of the centrifuge. As a consequence of the transport effect of the worm member 3, rotating at a difference speed with respect to the jacket, the solid matter layer is continuously transported to the interior wall of the centrifuge jacket in the direction leading to the solid matter discharge 8. Since the liquid-discharge drum openings 14, 16 are arranged between the slurry inlet 15 and the solid matter discharge 8, the centrifuge operates in parallel or uniflow manner. During the transport of the solid matter in the direction leading to the discharge 8, the latter passes the annular opening between the radial disk and the interior side of the jacket 1, 2 whereby the solid matter is forced at this location to a minimum exterior radius. The clarified or purified liquid still drains off before the baffle or diaphragm plate 13 through liquid openings 14, 16 and the channels 7, 7' and is discharged through the openings 12. Solid matter is conveyed to the discharge 8 through the worm spirals 4 in the conical portion 2 of the centrifuge and is likewise discharged. From there, the discharged solid matter reaches the pipe 39 and is controlled by the measuring apparatus 40 with regard to quantity and/or solid matter concentration.

The torque of the worm member 3 is determined with the aid of the measuring installation 43 associated with the differential gear 32, and this measured value is transferred to the computation unit 42, 48 which represents a significant part of the installation for the control and/or regulation of the speeds of drum 1, 2 and worm member 3.

This installation acts in such a manner that, in the case of a low torque—an indication of low solid matter concentration of degree of concentration in the solid matter discharge—the number of revolutions of the worm member 3 in proportion to the drum jacket 1, 2 and hence the differential speed is lowered. The reduction of the differential speed can be lowered to a specified limit value. If, upon reaching the specified limit value, a sufficient increase of the torque of the worm member 3 is not achieved, the installation for control and/or regulation 42, 48 increases the absolute speeds of the two rotating members while maintaining the differential speed, for example, through continuous or step-wise increase of the drive speed of the motor 33 with the aid of a control pulse presented to the regulating unit 35 of the motor 33 through the control line 46. Moreover, in this case the installation 42, 48 with the aid of the control line 49 acting on the regulating unit 37 of the throttling member 36, can further open the incoming current of the slurry through the inlet pipe 5 in the direction of the slurry inlet 15. The solid matter quantity is thereby increased in the centrifuge, as a consequence of which the efficiency of the centrifuge is increased, so that the solid matter attains the desired degree of concentration.

An additional engineering control technique can be parallel-implemented, or by itself alone, by virtue of the fact that with the lay-out of the measuring unit 40 for discharged solid matter quantity and/or solid matter concentration, an additional operating parameter is measured as the disburbance variable of the control system and a corresponding electric signal is impressed on the computation unit 42, 48 through the control line 41. In the case of two low a solid matter concentration or too low a solid matter quantity, the differential speed between jacket 1, 2 and worm member 3 is lowered, or, through the throttling member 36, the quantity of inflowing slurry and hence of the supplied solid matter quantity is increased with the speed remaining unchanged.

As an alternative use of the solid matter concentration in the solid matter discharge as the controlled variable, the solid matter concentration in the liquid separation product discharge 31 can also be ascertained as the operating parameter, and the determined value, as the disturbance variable or conductance, can be impressed on the installation 42, 48 for regulating and/or controlling the operating conditions of the centrifuge. In this case, the measured value is determined by the measuring unit 38 and impressed the computation unit 42, 48, through the control line 50.

Accordingly, in the case of an excessively high solid matter concentration in the liquid separation product, the differential speed is increased and the supplied solid matter quantity is reduced, for example, by throttling of the slurry supply, and vice-versa.

Basically, with all control operations discussed in the function-description above, it is to be understood that the signs of the control-operations can be reversed. This means, for example, that when the solid matter concentration in the liquid separation product falls below a specified lower limit, the differential speed would be lowered and/or the supplied solid matter quantity would be increased.

The examples of the invention according to FIGS. 1 and 2 are merely to be considered as schematic illustrations of possible embodiments. Structural or control-engineering modifications, to the extent that they lie in the judgment of the expert, therefore fall under the scope of the invention insofar as they comply with one of the valid patent claims.

Thus, instead of a throttling member, a controllable slurry pump can be arranged in the slurry inlet 51. Also, the sequence of the control operations is within the judgment of the expert.

In total, for influencing the control system, three input variables result:

(a) torque of the worm member
(b) in the solid matter discharge: quantity and concentration of solid matter
(c) in the liquid separation product discharge quantity and concentration of solid matter as well as three regulated quantities:

(a) speed of centrifuge jacket
(b) differential speed of jacket/worm member
(c) supplied solid matter/slurry quantity In the following, the invention shall be explained in greater detail on the basis of an example:

EXAMPLE

So-called digested sludge, decomposed by means of methano-bacteria from a biological sewage purification plant, undergoes water extraction or dehydration. A full jacket-worm centrifuge with 900 mm diameter and a length of 2,500 mm is employed.

Inflow concentration: 2.5 to 4% by weight dry substance (solid matter) in the slurry Inlet quantity: 35 to 40 $m^3/h$ Comparison values for two different designs A and B are summarized in the following table.

| Designation | A | B |
|---|---|---|
| Inlet ($m^3/h$) | 50 (constant) | (30) 35 (40) |
| Solid matter discharge (% by weight) | 18–22 | 28–32 |
| Liquid separation product (% by weight) | 1–2 | 1–3 |
| Consumption | | |
| Flocculant (kg/t) | 2.5–3 | 2.2–2.5 |
| Speed (r.p.m.) | 900 (constant) | 1000–1400 |
| Differential speed | 6 (constant) | 2–8 |

Result: With approximately equal conditions, the concentration effect 18–22→28–32 was significantly increased.

Due to a flexible adaptation of the operating parameters of the centrifuge to the respective varying operating conditions, in particular in the case of high solid matter loading due to fluctuations of the inflowing solid matter quantity, as a particularly positive assessed secondary effect of the invention, a blocking of the centrifuge was avoided with absolute certainity.

The construction of the throttling regulating unit 37, differential speed regulating unit 34, and motor regulating unit 35 is understood by those skilled in the system control art. For instance, these units may include solid-state units such as silicon controlled rectifiers. As to measuring units 38, 40, and 43, such units are well-known in the art and may be purchased as commercially available units. Finally, as to the control unit 42 with associated computing unit 48, this circuitry can be constructed by one familiar with the control system art by utilizing commercially available computing units having at least three output ports and at least three parameter input ports. The computing unit is simply programmed to adjust differential speed, motor speed, and throttling at unit 37 in accordance with a programmed analysis of the three input variables torque, solid matter concentration in the solid matter discharge, and solid matter concentration for liquid separation product.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A full jacket-worm centrifuge for continuous separation of water-sludge mixtures, comprising:

an approximately cylindrical drum jacket having a cylindrical section and a conically tapered section with a solid matter discharge at an end thereof, and a worm conveyor having cylindrical and conical portions arranged coaxially therein;

a slurry inlet for the drum jacket at an end wall thereof opposite the solid matter discharge;

a drive means for the drum jacket and worm conveyor;

at least one liquid drainage opening as a liquid separation product discharge arranged in an axial direction between the slurry inlet and the solid matter discharge substantially at a transition from the cylindrical section to the conically tapered section;

at said transition and between said liquid drainage opening and said solid matter discharge a cross-sectional constriction being provided comprising a retarding plate extending radially to a point spaced from an interior side of the drum jacket at said transition;

an exterior opening in the drum jacket and channel means connecting the liquid drainage opening to the exterior opening for conveying liquid thereto in a direction substantially opposite a transport direction of the solid matter and along and adjacent to said worm conveyor;

means for control of at least one of a differential speed between the drum jacket and worm conveyor or solid matter quantity supplied per unit of time to the centrifuge according to at least one of the operating parameters including torque of the worm conveyor, solid matter concentration in the solid matter discharge, or solid matter concentration in the liquid separation product discharge.

2. A full jacket-worm centrifuge according to claim 1 wherein said channels comprise axially aligned channels provided on the worm conveyor as liquid drain members associated with said liquid drainage opening.

3. A full jacket-worm centrifuge according to claim 1 wherein said drive means comprises means for determining torque of the worm conveyor and which converts the determined values into torque-proportional signals and directs these signals to a control unit.

4. A full jacket-worm centrifuge according to claim 1 wherein a flow meter means is outlet-connected to said solid matter discharge for determining the quantity and/or solid matter concentration in the discharge and to convert the determined values into electric signals, these signals being connected to the means for control.

5. A full jacket-worm centrifuge according to claim 1 wherein a flow meter means is outlet-connected to said liquid separation product discharge for determining the quantity and/or solid matter concentration in the discharge and to convert the determined values into electric signals, these signals being connected to the means for control.

* * * * *